US008781074B2

(12) United States Patent
Diaz Carmena et al.

(10) Patent No.: US 8,781,074 B2
(45) Date of Patent: Jul. 15, 2014

(54) DISCHARGE MODULE FOR HIGH VOLTAGE X-RAY TUBES

(75) Inventors: Angel Diaz Carmena, Algete (ES); Ildefonso Moreno Vallejo, Algete (ES); Francisco Diaz Carmena, Algete (ES)

(73) Assignee: Sociedad Espanola de Electromedicina y Calidad S.A., Algete Madrid (ES)

( * ) Notice: Subject to any disclaimer, the term of this patent is extended or adjusted under 35 U.S.C. 154(b) by 477 days.

(21) Appl. No.: 13/260,007

(22) PCT Filed: Mar. 25, 2009

(86) PCT No.: PCT/ES2009/070073

§ 371 (c)(1), (2), (4) Date: Nov. 1, 2011

(87) PCT Pub. No.: WO2010/109027

PCT Pub. Date: Sep. 30, 2010

(65) Prior Publication Data

US 2012/0057679 A1 Mar. 8, 2012

(51) Int. Cl.
*H05G 1/34* (2006.01)

(52) U.S. Cl.
CPC ..... *H05G 1/34* (2013.01)
USPC ..... 378/109

(58) Field of Classification Search
CPC ..... H01J 37/32935; H01J 37/32926; H01J 2235/02; H01J 2235/06; H01J 2235/086; H01J 2235/165; H01J 2235/20; H01J 35/04; H01J 35/16; H01J 2237/0048; H01J 2237/022; H01J 2237/032; H01J 2237/038; H01J 2237/0458; H01J 2237/0492; H01J 2237/061; H01J 2237/06333; H01J 2237/166; H01J 2237/182; H01J 2237/2008; H01J 2237/2482; H01J 2237/2485; H01J 2237/2608; H01J 2237/28; H01J 2237/2817; H01J 37/28; H01J 37/29; H01J 37/301; H01J 37/3056; H01F 27/38; H01F 29/04; H01F 19/08; H01F 2017/067; H01F 2019/085; H01F 2038/006; H01L 45/1233; H01L 45/146; H01L 45/1625; H01L 27/2436; H01L 45/08; H01L 27/101; H01L 45/04; H01L 27/2409; H01L 45/1253; H01L 45/1675; H01L 27/12; H01L 27/1225; H01L 41/18; H01L 45/147; H01L 21/02189; H01L 21/022; H01L 21/0228; H01L 21/28202; H01L 21/28273; H01L 21/31138; H01L 21/3141; H01L 21/31641; H01L 21/318; H01L 21/32139; H01L 21/67069; H01L 21/67253; H01L 22/22; H01L 27/10873; H01L 27/10897; H01L 27/11517; H01L 27/1156; H01L 27/11803; H01L 27/1203; H01L 27/1251; H01L 27/14603; H01L 27/1461; H01L 27/14614; H01L 27/14616; H01L 27/14659; H01L 27/14676; H01L 27/14683; H01L 27/148; H01L 28/40; H01L 29/0611; H01L 29/0661; H01L 29/0673; H01L 29/1029; H01L 29/2003; H01L 29/517; H01L 29/7787; H01L 29/78609; H01L 29/7869; H01L 31/09; H01L 41/0478; H01L 41/0815; H01L 41/0833; H01L 41/187; H01L 41/1873; H01L 41/1878; H01L 41/316; H01L 41/318; H01L 45/1273; H01L 45/145; H01L 45/16; H01L 51/0093; H01L 51/0595; H05G 1/10; H05G 1/06; H05G 1/265; H05G 1/30; H05G 1/44; H05G 1/46; H05G 1/56; H05G 1/58; H05H 3/06; H05H 9/00; G21K 5/00
USPC ..... 378/109
See application file for complete search history.

(56) References Cited

U.S. PATENT DOCUMENTS

| | | | | |
|---|---|---|---|---|
| 3,749,943 | A * | 7/1973 | Lambert | 307/117 |
| 4,679,218 | A | 7/1987 | Brunn | |
| 5,056,125 | A | 10/1991 | Beland | |
| 5,333,169 | A | 7/1994 | Koertge | |
| 5,495,165 | A * | 2/1996 | Beland | 323/270 |
| 2008/0089482 | A1 * | 4/2008 | Soto | 378/101 |

FOREIGN PATENT DOCUMENTS

| | | | |
|---|---|---|---|
| EP | 0279317 | | 8/1988 |
| JP | 10189286 | | 7/1998 |
| JP | 10189286 | A * | 7/1998 |
| JP | 2007234497 | | 9/2007 |

OTHER PUBLICATIONS

USPTO 14-0381 which is a translation of Watanabe, JP10189286A.*

* cited by examiner

*Primary Examiner* — Toan Ton
*Assistant Examiner* — John Corbett
(74) *Attorney, Agent, or Firm* — Dickinson Wright PLLC

(57) ABSTRACT

Discharge module which is formed by three circuits, a control and measurement circuit for X-rays, a voltage division circuit between serial switches, which is independent from the previous one, and a third circuit of the charge short circuit, which in turn is formed by a successive or slave trip circuit of the switches and another main discharge circuit through the switches; due to the established configuration, a much improved radiation control is achieved as it is not affected by unforeseen agents, the short circuit current is not restricted to the port current of the switches, and residual voltage of the switches is reduced.

3 Claims, 2 Drawing Sheets

DISCHARGE MODULE FOR HIGH VOLTAGE X-RAY TUBES

CROSS-REFERENCE TO RELATED APPLICATIONS

This Application is a National Stage of International Application No. PCT/ES2009/070073, filed Mar. 25, 2009. The entire disclosure of the above application is incorporated herein by reference.

The object of this invention is a discharge module for high voltage x-ray tubes, which reduces soft radiation caused by the tail discharge of the filter capacities and high voltage cables.

In a conventional x ray tube, the x rays are produced by the generation of electrons through thermionic emission from a tungsten filament (cathode). The electrons are accelerated to an anode (which may be rotating to mitigate the effects of wear) in order to generate x-rays. The intensity of the tube emission is controlled by the filament current and by the difference of high voltage potential between the anode and the cathode.

An accurate control of the power supplied to an x-ray tube is important to ensure the correct image for diagnostic purposes, and to avoid unnecessary exposure of the patient to radiation from x-rays which do not produce a usable image.

The "tail" in the outlet wave form of the energy supplied produces an undesirable soft radiation which gives the patient an added dose of x-ray exposure and does not improve the image obtained. It would therefore be desirable to obtain a high voltage supply for an x-ray tube which produces substantially rectangular wave forms without a tail of undesirable soft radiations.

Therefore, this invention is circumscribed by the scope of high voltage generation equipment for x-ray tubes, and specifically within the scope of discharge modules of a high voltage cable which connects a high voltage source and an x-ray generation source.

BACKGROUND TO THE INVENTION

To date, voltage discharge modules are known for cables which connect a high voltage supply with an x-ray generation sources such as that described in U.S. Pat. No. 5,056,125 A.

Said discharge module, although it partially achieves a reduction in the discharge tail or soft radiation, presents several disadvantages. On one hand as the voltage discharge circuits and mA measurement are not independent, the radiation control is not as accurate, as it is interfered with by unforeseeable external agents, and on the other, the discharge current of the thyristors or triacs used to reduce soft radiation is restricted to the port current that the said solid state switches are able to support.

Another difficulty of the discharge module of the previous invention is the fact that both the anode and the cathode discharge in a manner independent of an earth, therefore the discharge depends on the earth connection, and if one of said discharge connections fails, the discharge will not occur.

Therefore, the purpose of this invention overcomes the foregoing disadvantages by developing a discharge module which reduces soft radiation, in which the discharge current is not restricted to the port current which can support the solid state switches, where furthermore, the anode and cathode discharge is made in a more efficient manner and in which the voltage discharge current is separated from the mA measurement, in accordance with the topology contained in claim one.

DESCRIPTION OF THE INVENTION

The invention of a discharge module for high voltage cables of X-ray tubes is characterised in that it includes three independent circuits.

On one hand a control circuit and X-ray measurement and on the other a voltage discharge circuit between serial switches and leak currents of the switches themselves, a circuit which is arranged independently from the mA measurement. Finally, there is a third circuit which is the short circuit of the charge formed by the actual X-ray tube and the high voltage capacities.

The short circuit of the charge circuit is in turn divided into two independent circuits, on one hand a port trip circuit of the solid state switches (thyristors, triacs etc) which is formed by a serial arrangement of serial port condensers with serial resistances, equivalent to a slave trip of serial thyristors. The second main discharge circuit which forms part of the short circuit circuit is a main discharge circuit formed by the serial arrangement of a discharge resistance and a succession of serial thyristors.

Due to the fact that the main discharge current passes directly through the actual thyristors and not through the thyristor ports or their equivalent, the discharge current is not restricted to the port current values of the thyristors.

Due to the fact that the control and measurement circuit and the discharge circuit are independent, the radiation control is much more accurate as there is no interference from leak currents caused by external agents.

And finally, due to the fact that it produces a multi-point trip, the residual line surge of the switches is reduced.

DESCRIPTION OF THE DRAWINGS

This descriptive report is complemented by a set of plans in order to provide a better understanding of the invention, illustrating the most significant details but which is in no way restrictive of the invention.

PREFERRED EMBODIMENT OF AN INVENTION

In the light of the figures below a preferred embodiment of the proposed invention is described.

Figure 1:
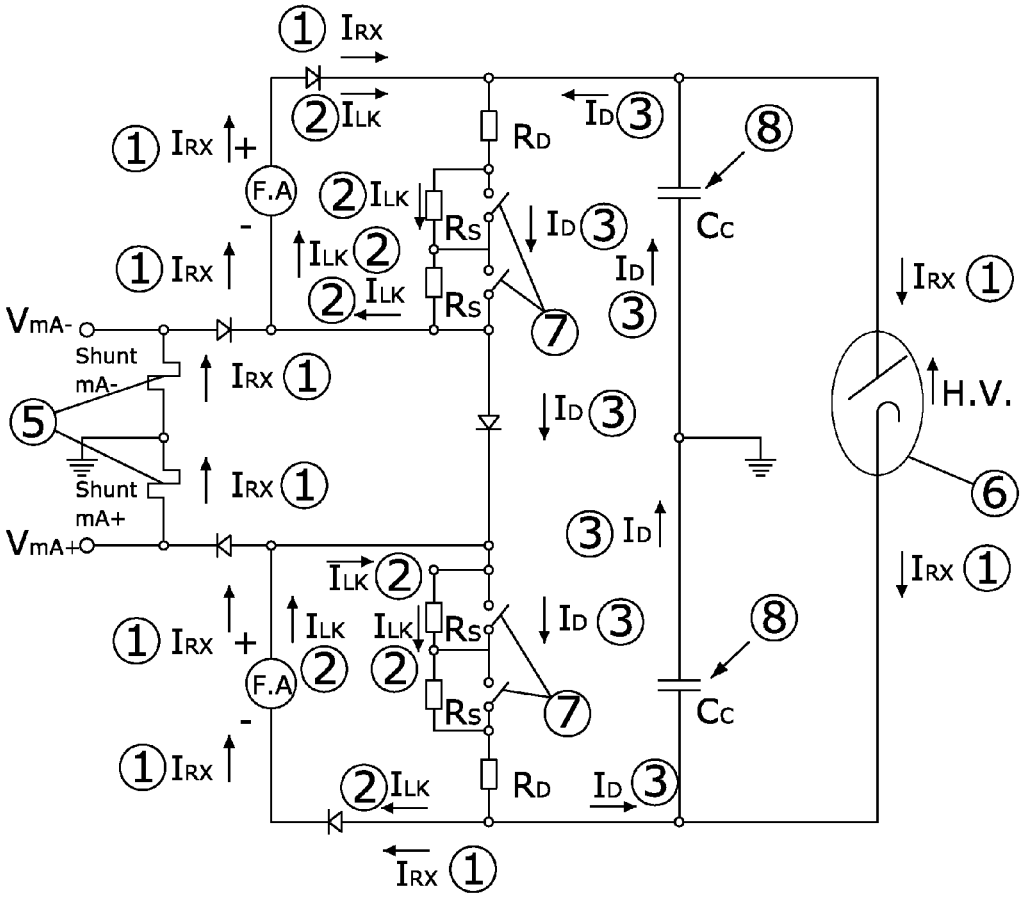
FIG. 1, shows a general depiction of the topology of the discharge module proposed showing its main components and circuits.

In FIG. 1, we note the topology for reducing the soft radiation due to the discharge tail of the filter capacities and high voltage cables of an X-ray tube (H.V.).

Said topology comprises three independent circuits:

The circuit (1) which is the control and measurement circuit of X-rays and through which the $I_{Rx}$ current circulates, the current passes through two shunts (5) through diodes, through the high voltage supply sources (F.A.) and through the X-ray tube itself (6).

The circuit (2) which is a voltage division circuit between switches (7), through which the $I_{LK}$ current circulates and which is independent from the mA measurement circuit.

The circuit (1) which is the control and measurement circuit of the current in charge of produce X-rays and through which the $I_{Rx}$ current circulates, the current passes through two shunts (5) through diodes, through the high voltage supply sources (F.A.) and through the X-ray tube itself (6). The circuit (2) which is a voltage division circuit between switches (7), through which the $I_{LK}$ current circulates and which is independent from the mA measurement circuit, not been allowed circulation of leak current through the control and measurement circuit. The circuit (3) which is a short circuit of the charge formed by the X-ray tube itself (6) and the high voltage capacities (8).

Due to the previously described topology and the conformation of a circuit (3) short circuit, the discharge of the anode and the cathode is made in a more efficient manner, by being made from the anode to the cathode, and not from these to the earth, as occurs with the previous devices in the art.

Figure 2:
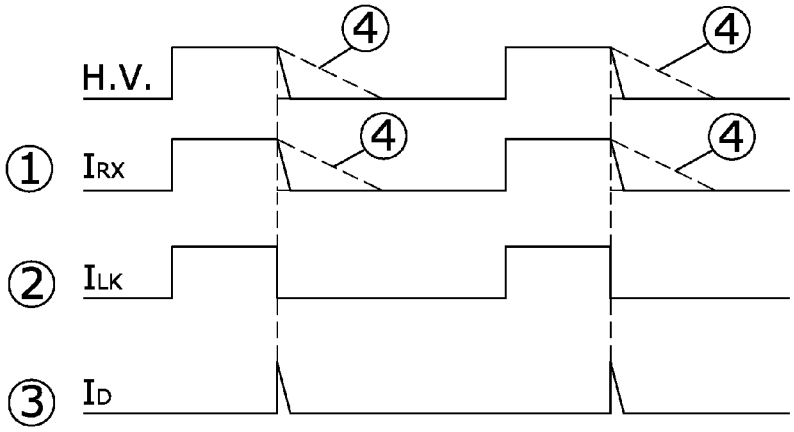
FIG. 2, shows a representation of the different wave forms presented by the currents of the different circuits.

FIG. 2, shows the wave forms of the different currents circulating through the various circuits. Thus the form of the upper wave is that of high voltage wave form, where it may seen that it has a slightly inclined discharge side however clearly cut in relation to the side (4) represented by a dotted line, which represents the wave form which would be present the voltage if the discharge circuit produced excessive soft radiation, that is, undesirable radiation because it does not serve the purpose of obtaining an image with sufficient quality, and which, however, exposes the patient to unnecessary radiations.

The following wave form represented below corresponds to the wave form of the $I_{Rx}$ current which circulates through the X-ray tube and which presents a wave form equal to that of high voltage and which also seeks to reduce the soft radiation represented by the dotted line, up to the almost vertical side represented by the continuous line.

The following wave form corresponds to the wave form of the current which runs through the voltage division circuit between the switches (7), which presents a perfectly rectangular wave form and which is independent from the $I_{Rx}$ current.

Finally, the last wave form shown corresponds to the wave form of the circuit of the charge short circuit, which presents a left side corresponding to the closing moment of the switches and an almost vertical right side. The more vertical the right side of the discharge current, the less soft radiation will occur.

Figure 3:
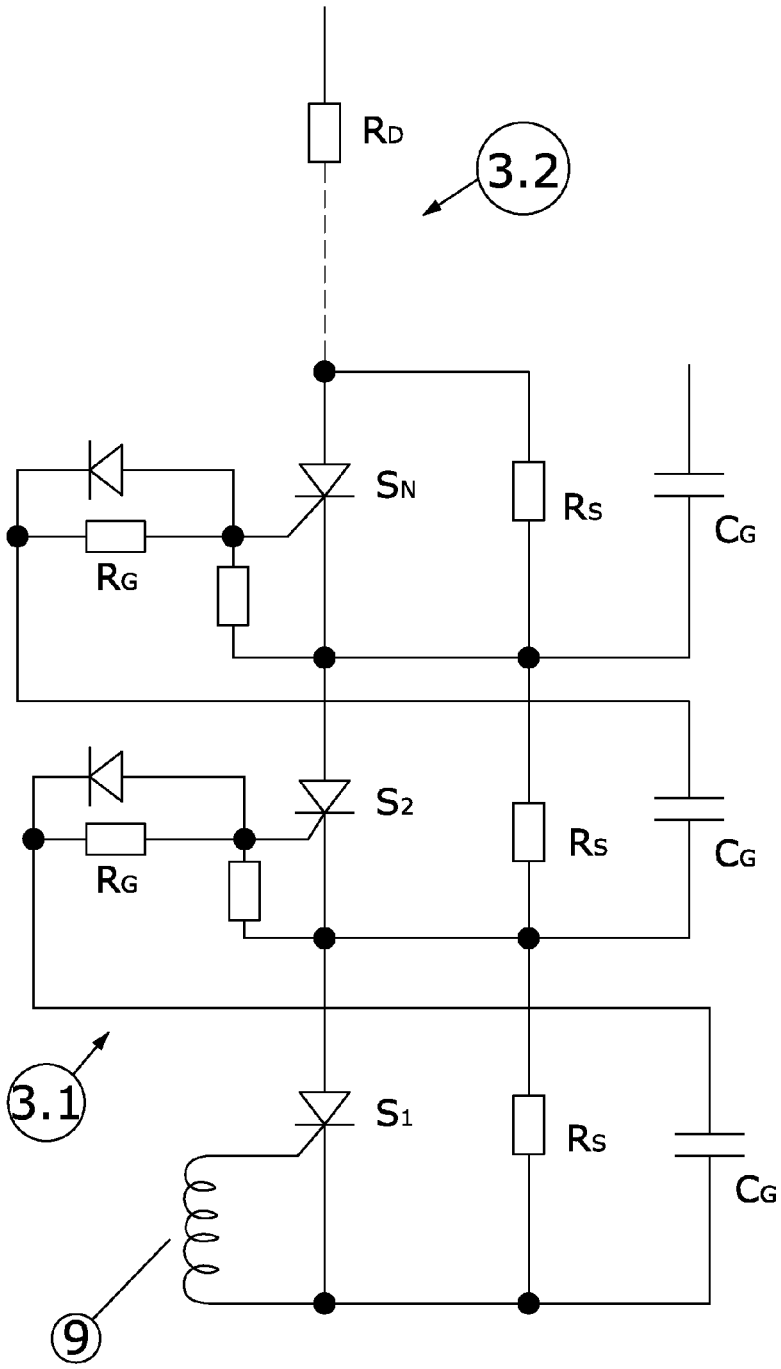
FIG. 3, shows a detail of the topology of the short circuit of the charge circuit.

Finally, in FIG. 3, a detailed configuration of the short circuit circuit (3) is shown, in which various branches have been depicted but which, however, could reach various branches, as required, in order to obtain a voltage of, for example, 75,000 volts, which in a possible embodiment might need up to 80 branches. Said short circuit circuit (3) comprises two circuits:

A trip circuit (3.1) of the ports ($C_G$, $R_G$) of the switches, in the case shown they are thyristors, however they could be any type of switch which fulfils the purpose of switching. The first of the thyristors ($S_1$) trips by means of a transformer (9), then the discharge of the associated condenser $C_G$ begins through the port of the second thyristor $S_2$, through which the second thyristor trips, such that as the second thyristor $S_2$ is activated, the associated $C_G$ condenser discharge begins through the port of the third thyristor and so on successively. A slave trip of connected thyristors is produced, that is, successively. Due to the multipoint trip, residual surge of the switches is reduced.

A second main discharge circuit (3.2) formed by the succession of $R_D$, $S_1$, $S_2$, . . . , $S_N$. The advantage of this configuration is that the discharge current is not restricted to the port current of the switches.

The essential nature of this invention is not altered in any way by variations in materials, form, shape and arrangement of the component elements which are described in a manner which is in no way restrictive but which is sufficient for an expert to proceed to its reproduction.

The invention claimed is:

1. A discharge module for high voltage cables of X-ray tubes comprising three circuits:

a control and measurement circuit through which a current $I_{Rx}$ circulates through two shunts, diodes, the high voltage supply source and the X-ray tube;

a circuit which is a voltage division circuit among switches (7), through which leakage current $I_{LK}$ circulates;

a circuit which is a short circuit of the charge formed by the X-ray tube and the high voltage capacities; and wherein the leakage current $I_{LK}$ circulates only through the voltage division circuits and not through the control and measurement circuit.

2. The discharge module for high voltage X-ray tubes according to claim 1 wherein the short circuit of the charge circuit is formed by two circuits:

a first circuit, which is a trip circuit of ports of the switches and a second circuit, which is a main discharge circuit formed by the serial succession of switches $R_D$, $S_1$, $S_2$, . . . , $S_N$.

3. The discharge module for high voltage cables of X-ray tubes according to claim 2 wherein the switches are solid state switches such as thyristors, triacs or the like.

* * * * *

UNITED STATES PATENT AND TRADEMARK OFFICE

CERTIFICATE OF CORRECTION

PATENT NO. : 8,781,074 B2
APPLICATION NO. : 13/260007
DATED : July 15, 2014
INVENTOR(S) : Angel Diaz Carmena et al.

It is certified that error appears in the above-identified patent and that said Letters Patent is hereby corrected as shown below:

In the Specification

Column 3, Lines 1-10 and Line 11 to the word circuit should be deleted as it is duplicated.

Signed and Sealed this
Third Day of March, 2015

Michelle K. Lee

Michelle K. Lee
*Deputy Director of the United States Patent and Trademark Office*